United States Patent [19]

Boswell

[11] 4,176,982

[45] Dec. 4, 1979

[54] BICYCLE PATH TRANSPORT SYSTEM

[76] Inventor: James W. Boswell, 9610 Deering Ave., Livonia, Mich. 48150

[21] Appl. No.: 847,405

[22] Filed: Oct. 31, 1977

[51] Int. Cl.[2] ..... E01C 5/00

[52] U.S. Cl. ..... 404/34; 52/476; 272/1 R; 404/7

[58] Field of Search ..... 272/3, 4, 5, 1 R; 404/34, 35, 43, 40, 37, 7; 52/476

[56] References Cited

U.S. PATENT DOCUMENTS

| | | | |
|---|---|---|---|
| 166,486 | 8/1975 | Thormann | 404/34 |
| 2,228,763 | 1/1941 | Henderson | 404/43 |
| 2,308,943 | 1/1943 | Tietig | 404/43 X |
| 3,065,506 | 11/1962 | Tremer | 404/43 X |
| 3,348,459 | 10/1967 | Harvey | 404/40 X |
| 3,855,747 | 12/1974 | Langan | 404/34 X |
| 3,859,768 | 1/1975 | Donzis | 272/3X |
| 3,909,145 | 9/1975 | Ayer | 404/40 |

*Primary Examiner*—Nile C. Byers, Jr.
*Attorney, Agent, or Firm*—Olsen and Stephenson

[57] ABSTRACT

Apparatus is disclosed for construction of a bicycle path on the berm of roadways, or the like, and includes standard components such as rails, runners, shim members and spikes whereby the path can be constructed either on existing berms or as part of new construction projects, and a smooth surface for bicycle travel will be provided by endless runners that have side boundaries defined by rails.

8 Claims, 9 Drawing Figures

BICYCLE PATH TRANSPORT SYSTEM

BACKGROUND OF THE INVENTION

The present invention relates to a transportation system, particularly adapted for use by bicyclists.

The use of bicycles as a mode of travel either for purposes of exercise and recreation or for transportation is greatly restricted because of the nearly complete absence of suitable bicycle paths. Vast sums of money have been expended for an interstate highway system which provides excellent facilities for motor vehicles, but these facilities are essentially unusable by bicyclists for reasons of safety and because of minimum speeds that are frequently imposed. Similarly, rural roads and highways are often unusable to bicyclists, although not always to the same degree of limitation. To be economically practical, bicycle paths for transportation purposes must be part of the roadway right-of-way, and therefore, there is a need for a bicycle path transportation system that can be used safely and practically in conjunction with existing motor vehicle road systems or new road constructions, as well as in other areas, such as parks, recreational areas, or the like.

SUMMARY OF THE INVENTION

The present invention has overcome the inadequacies of the prior art and provides a system that can readily be installed on any berm or surface to afford optimum travel conditions for bicyclists, and the system is constructed and arranged to facilitate its installation either at new road construction projects, existing roads, parks, or the like.

According to a preferred form of the present invention, a bicycle path transport system of indefinite length is provided which is adapted to be mounted on a berm or a similar supporting surface, and it comprises a plurality of pairs of rails connected end-to-end and supported in spaced parallel relationship on the berm. Each rail has a groove extending longitudinally in the inner side wall thereof that faces the opposite parallel rail. A plurality of runners are connected end-to-end and extend lengthwise in the space between the pairs of rails to provide a smooth continuous surface therebetween for bicycle travel. The outer edges of the runners are retained in the grooves of the adjacent rails so that the runners span the space between the parallel rails and the rails serve as boundaries for the bicycle path. The rails and runners are made of elastomeric material to allow flexing of the rails and runners during installation to accommodate contours in the berm. The runners will be supplied in sections of predetermined length, and some of the sections may be curved in a horizontal plane to accommodate bends that occur in the roadway. Suitable drainage holes may extend through the runners, and similar drainage ducts may also extend transversely through the rails.

The runners will be connected at their ends in a manner to provide a smooth joint, and the connecting joints will be made by utilizing spikes which will extend through the runners and into the berm for supporting the runners in place. Preferably, the rails will be positioned end-to-end in abutting relationship and spikes will extend through the rails into the berm, also to retain them in place. Shim members are provided which can be positioned under the rails and on the berm for supporting the rails at desired elevations. These shims will be retained in place by the same spikes which extend through the rails into the berm. The rails also have ducts on the underside of the grooves that serve to retain the runners, and these ducts may be used to introduce additional filler material under the runners, if this is necessary during installation. The filler material under the runners may be any fluid material which can remain in a fluid state or which can subsequently set into a hard substance for supporting the runners.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
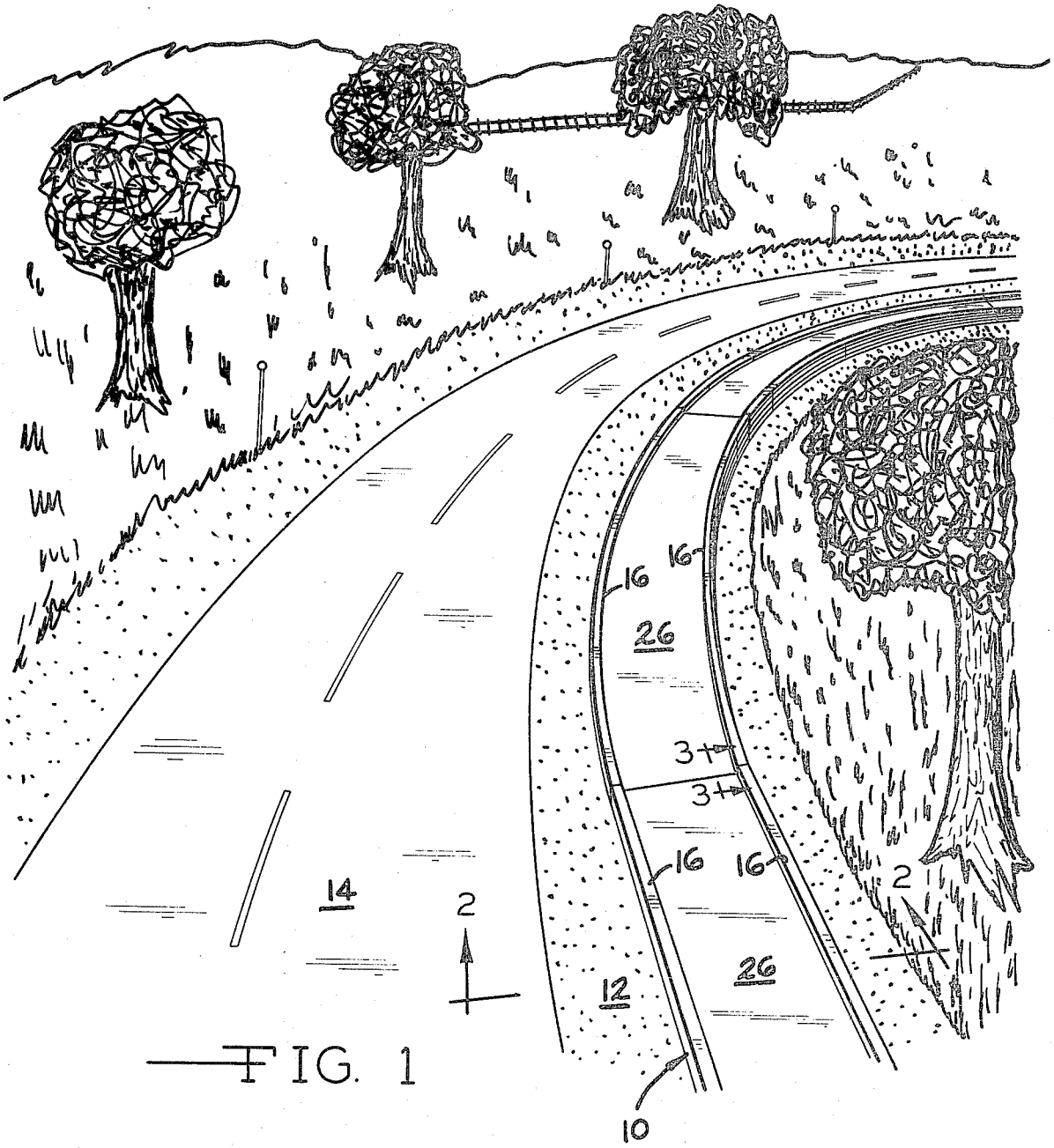
FIG. 1 is a perspective view of a roadway showing a bicycle path transport system embodying the present invention mounted on the berm of the roadway.

Referring now to the drawings, the invention will be described in greater detail. In FIG. 1, the bicycle path transport system 10 is shown mounted on the berm 12 of a conventional roadway 14. The bicycle path that is provided is of indefinite length, normally extending the full length of the roadway 14.

Figure 7:
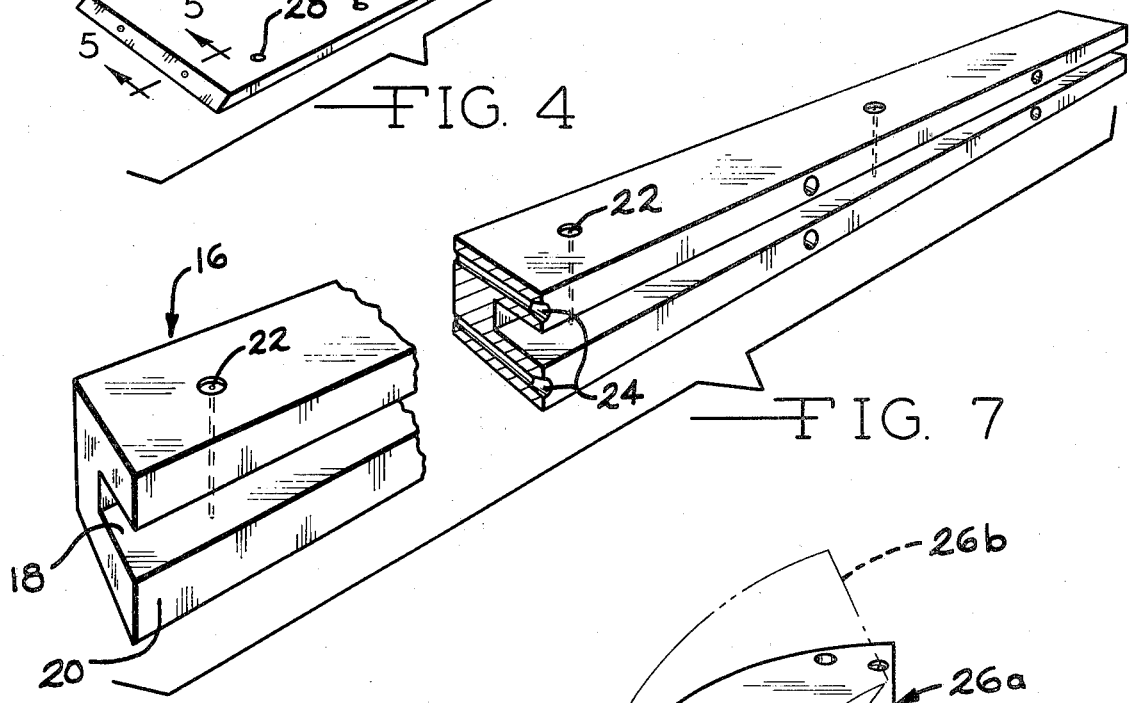
FIG. 7 is a perspective view of a rail that is used in the present invention.

The bicycle path transport system includes a plurality of pairs of rails 16 that are connected end-to-end and supported in spaced parallel relationship on the berm 12. The rails 16 are constructed the same and can be used interchangeably on either side of the path. Each of the rails, as shown in FIG. 7, has a groove 18 extending longitudinally of the rail on the inner side wall 20 thereof so that when assembled as part of the path, the inner side wall of one rail will face the inner side wall of the opposite parallel rail. Each rail 16 is provided with a plurality of spike holes 22 for use in mounting the rail in place on the berm 12. Each rail 16 also has a plurality of ducts 24 extending transversely therethrough at locations above and below the groove 18, for purposes that will be described subsequently.

Figure 2:
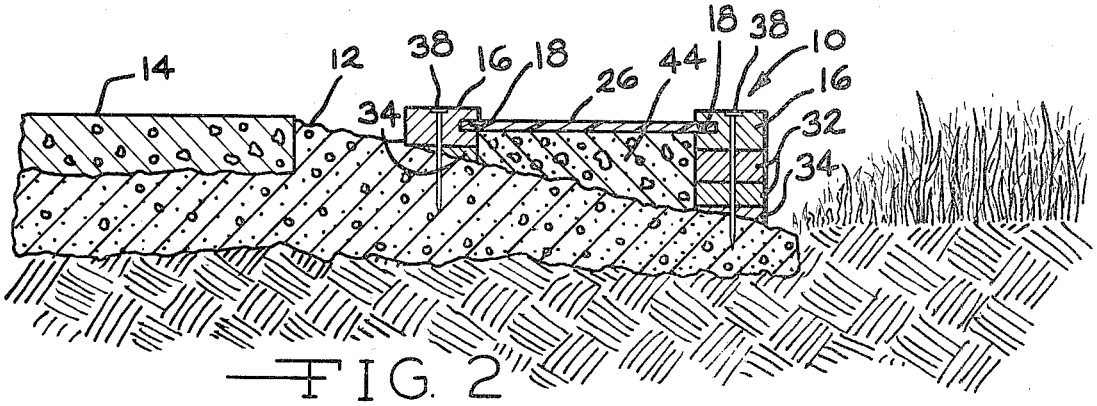
FIG. 2 is an enlarged fragmentary section taken on the lines 2—2 of FIG. 1.
Figure 4:
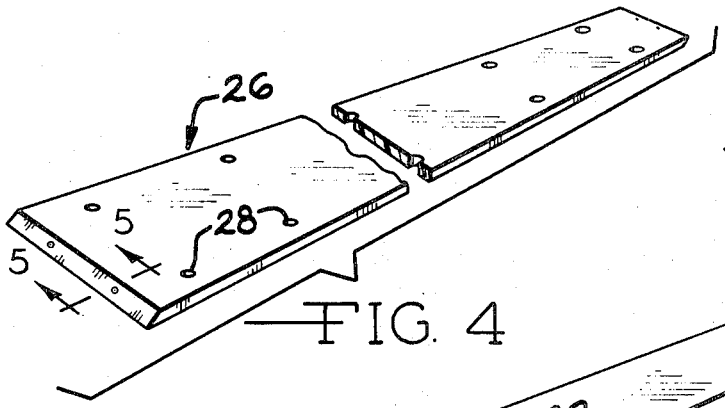
FIG. 4 is a perspective view of one runner that is a component of the bicycle path transport system.
Figure 5:
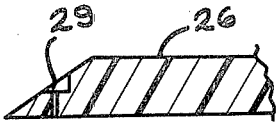
FIG. 5 is an enlarged fragmentary section taken on the lines 5—5 of FIG. 4.
Figure 3:
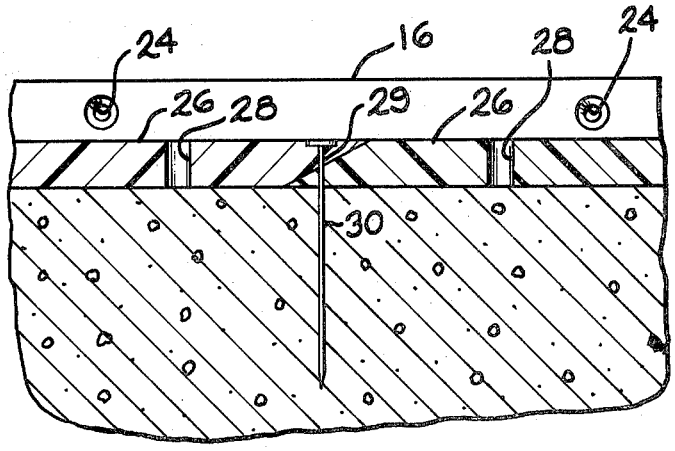
FIG. 3 is an enlarged fragmentary section taken on the lines 3—3 of FIG. 1.

Connected end-to-end and extending lengthwise in the space between the pairs of rails 16 so as to provide a smooth continuous surface therebetween for bicycle travel are a plurality of runners 26. The outer edges of the runners are retained in the grooves permitting the runners to span the space between the parallel rails, as can be seen best in FIG. 2. Each of the runners 26 is provided with a plurality of drain holes 28, and the ends of the runners have beveled portions that are adapted to fit in overlapping position in a complementary relationship, as shown in FIG. 3, and have spike holes 29 to permit the spikes 30 to be driven through them for retaining the runners together.

To accommodate the slopes which occur in berms, suitable shim members 32 and 34 are employed. Shim members 32 have a rectangular cross section and shim members 34 have a triangular cross section so that the runners 26 can be supported in a horizontal position, or at a selected angular slope for curves, as may be desired. Only one shim member 34 is shown having a triangular cross section, but it is to be understood that other shims of this character may be supplied having different triangular cross sections to accommodate varying slopes of the berm that may be encountered. The shims 32 have apertures 36 therein to accommodate the spikes 38 which are used to secure the rails in place, and the shims 34 have similar apertures 40 for receiving the same spikes 38. Transverse ducts 42 are also provided in the shims 32 for use either in filling fluid or granular material 44 under the runners 26 or for drainage purposes for the removal of moisture from this space.

Figure 6:
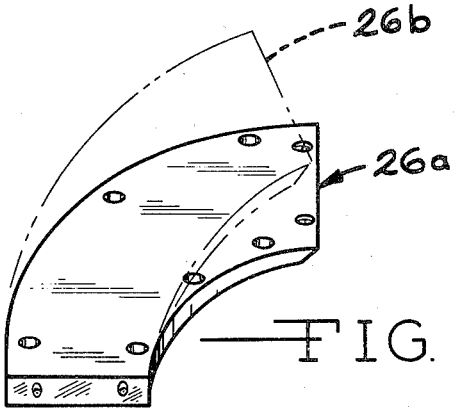
FIG. 6 is a perspective view showing in solid lines one runner adapted for use at a sharp curve in the path, and showing in broken lines a second runner for use where a lesser curvature is required.
Figure 8:
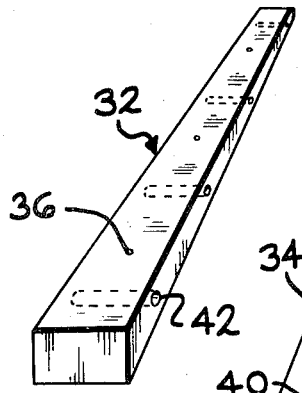
FIG. 8 is a perspective view of a shim having a rectangular cross section.
Figure 9:
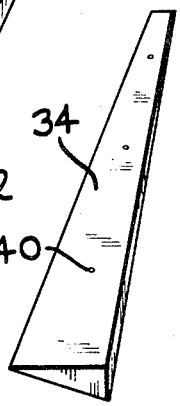
FIG. 9 is a perspective view of another shim having a triangular cross section.

The rails and runners are made of suitable elastomeric material to allow flexing of the rails and runners to accommodate contours in the berm 12. Similarly, the shims 32 and 34 will be made of the same or similar elastomeric materials. Also, to accommodate curves in the path that are greater than the flexing of the elastomeric runners may tolerate, it is contemplated that runners of preselected different curvature in the horizontal plane will also be used. As shown in FIG. 6, a runner 26A is provided having a substantially severe curvature, and a second runner 26B is shown having a lesser curvature. Appropriate runners of this character will be utilized when constructing curves, such as are shown in FIG. 1 of the drawing.

What is claimed:

1. A bicycle path transport system of indefinite length mounted on a berm or similar supporting surface, comprising a plurality of pairs of flexible rails connected end-to-end and supported in spaced parallel relationship on said berm or similar supporting surface, each rail having a groove extending longitudinally of the rail in the inner side wall thereof facing the opposite parallel rail, a plurality of flexible runners connected end-to-end and extending lengthwise in the space between said pairs of rails to provide a smooth continuous surface therebetween for bicycle travel, the outer edges of said runners being retained in the grooves of the adjacent rails so that the runners span the space between the parallel rails, said rails and said runners being flexible to a degree sufficient to allow flexing of the rails and runners to accommodate contours in the berm or similar supporting surface, certain of said runners being curved in a horizontal plane to provide curves in the path when initially installing the system, and shim members positioned between said rails and the berm or similar supporting surface for supporting said rails at desired elevations so that the runners can be curved to either side, sloped up or down and tilted at any angle on the supporting surface.

2. The bicycle path transport system that is defined in claim 1, wherein said rails and said runners are made of elastomeric material.

3. The bicycle path transport system that is defined in claim 1, wherein said runners have drain holes extending through them at spaced longitudinal intervals.

4. The bicycle path transport system that is defined in claim 1, wherein said rails have ducts extending transversely through them at locations above and below said runners and from said inner side walls to the outer side walls thereof.

5. The bicycle path transport system that is defined in claim 1, wherein said runners are connected end-to-end by complementary overlapping end portions and spikes extend through said end portions into said berm.

6. The bicycle path transport system that is defined in claim 1, wherein said rails are connected end-to-end in abutting relationship and spikes extend through said rails into said berm.

7. The bicycle path transport system that is defined in claim 1, wherein spikes extend through said rails and said shim members into the berm.

8. The bicycle path transportation system that is defined in claim 7, wherein a material capable of supporting loads applied to said runners occupies the space defined between said berm and the runners.

* * * * *